US012571218B2

(12) United States Patent
Nerkar et al.

(10) Patent No.: US 12,571,218 B2
(45) Date of Patent: Mar. 10, 2026

(54) SOUND DAMPENED FLOORING WITH IMPROVED ACOUSTIC PERFORMANCE

(71) Applicants: Dow Global Technologies LLC, Midland, MI (US); Rohm and Haas Company, Collegeville, PA (US)

(72) Inventors: Manoj Nerkar, Royersford, PA (US); Ian D. Robertson, Collegeville, PA (US); Manoj Thota, Midland, MI (US)

(73) Assignees: Dow Global Technologies LLC, Midland, MI (US); Rohm and Haas Company, Collegeville, PA (US)

( * ) Notice: Subject to any disclaimer, the term of this patent is extended or adjusted under 35 U.S.C. 154(b) by 194 days.

(21) Appl. No.: 18/255,927

(22) PCT Filed: Dec. 2, 2021

(86) PCT No.: PCT/US2021/061510

§ 371 (c)(1),
(2) Date: Jun. 5, 2023

(87) PCT Pub. No.: WO2022/125360

PCT Pub. Date: Jun. 16, 2022

(65) Prior Publication Data

US 2024/0052645 A1 Feb. 15, 2024

Related U.S. Application Data

(60) Provisional application No. 63/124,195, filed on Dec. 11, 2020.

(51) Int. Cl.
*E04F 15/20* (2006.01)
*E04F 15/10* (2006.01)

(52) U.S. Cl.
CPC ..... *E04F 15/206* (2013.01); *E04F 15/105* (2013.01); *E04F 15/107* (2013.01); *E04F 2290/041* (2013.01)

(58) Field of Classification Search
CPC ..... E04F 15/10; E04F 15/20; E04F 15/105; E04F 15/107; E04F 15/102; E04F 15/206;
(Continued)

(56) References Cited

U.S. PATENT DOCUMENTS 4,733,005 A 3/1988 Schmidt et al.
6,492,451 B1 12/2002 Dersch et al.
(Continued)

FOREIGN PATENT DOCUMENTS

CA 3058007 A1 * 10/2018 ..... B05D 3/0254
CN 100467502 C * 3/2009 ..... C08F 265/06
(Continued)

OTHER PUBLICATIONS

"Polymer Handbook", edited by J. Brandrup and E. H. Immergut, Interscience Publishers, 1966.

*Primary Examiner* — Edgardo San Martin
(74) *Attorney, Agent, or Firm* — Warner Norcross + Judd LLP

(57) ABSTRACT

A method of preparing sound dampened flooring comprises providing a flooring substrate, applying a coating of a liquid acrylic sound damping composition to a surface of the flooring substrate, drying the coating, and optionally, forming one or more additional layers on the coating. A sound dampened flooring is also disclosed.

18 Claims, 1 Drawing Sheet

(58) Field of Classification Search
CPC ..... E04F 15/203; E04F 2290/044; E04F 2290/041; E04F 2290/04; E04F 2290/042; B32B 25/14; B32B 2255/26; B32B 2419/04; E04B 1/82; E04B 1/8209; E04B 2001/8263; E04B 2001/8254
See application file for complete search history.

(56) References Cited

U.S. PATENT DOCUMENTS

| | | | | |
|---|---|---|---|---|
| 8,146,310 | B2 | 4/2012 | Keene | |
| 8,640,824 | B2 | 2/2014 | Freedman et al. | |
| 9,157,241 | B2 | 10/2015 | Boyadjian et al. | |
| 10,265,929 | B2 | 4/2019 | Lee et al. | |
| 10,933,605 | B2 * | 3/2021 | Shen | B32B 9/041 |
| 2007/0094978 | A1 * | 5/2007 | Svanholm | E04F 15/02 52/480 |
| 2010/0018799 | A1 | 1/2010 | Boyadjian et al. | |
| 2010/0160495 | A1 | 6/2010 | Teramoto et al. | |
| 2011/0281978 | A1 | 11/2011 | Desai et al. | |
| 2012/0103722 | A1 * | 5/2012 | Clausi | B32B 27/308 156/60 |
| 2014/0302294 | A1 | 10/2014 | Freedman et al. | |
| 2018/0022056 | A1 | 1/2018 | Shen et al. | |
| 2022/0213693 | A1 * | 7/2022 | Courey | B32B 27/32 |
| 2023/0235574 | A1 * | 7/2023 | Hoffman | B32B 27/08 428/319.3 |
| 2023/0366212 | A1 * | 11/2023 | Courey | B32B 27/20 |
| 2024/0040758 | A1 * | 2/2024 | Shoda | B32B 27/08 |

FOREIGN PATENT DOCUMENTS

| | | | | |
|---|---|---|---|---|
| JP | H10102622 | A * | 4/1998 | |
| JP | 2002302583 | A * | 10/2002 | |
| JP | 2006225441 | A | 8/2006 | |
| JP | 2007262137 | A | 10/2007 | |
| JP | 2011074233 | A * | 4/2011 | |
| JP | 4938031 | B2 * | 5/2012 | E04B 1/68 |
| KR | 101435993 | B1 * | 9/2014 | |
| KR | 102106514 | B1 * | 5/2020 | |
| KR | 102552819 | B1 * | 7/2023 | |

* cited by examiner

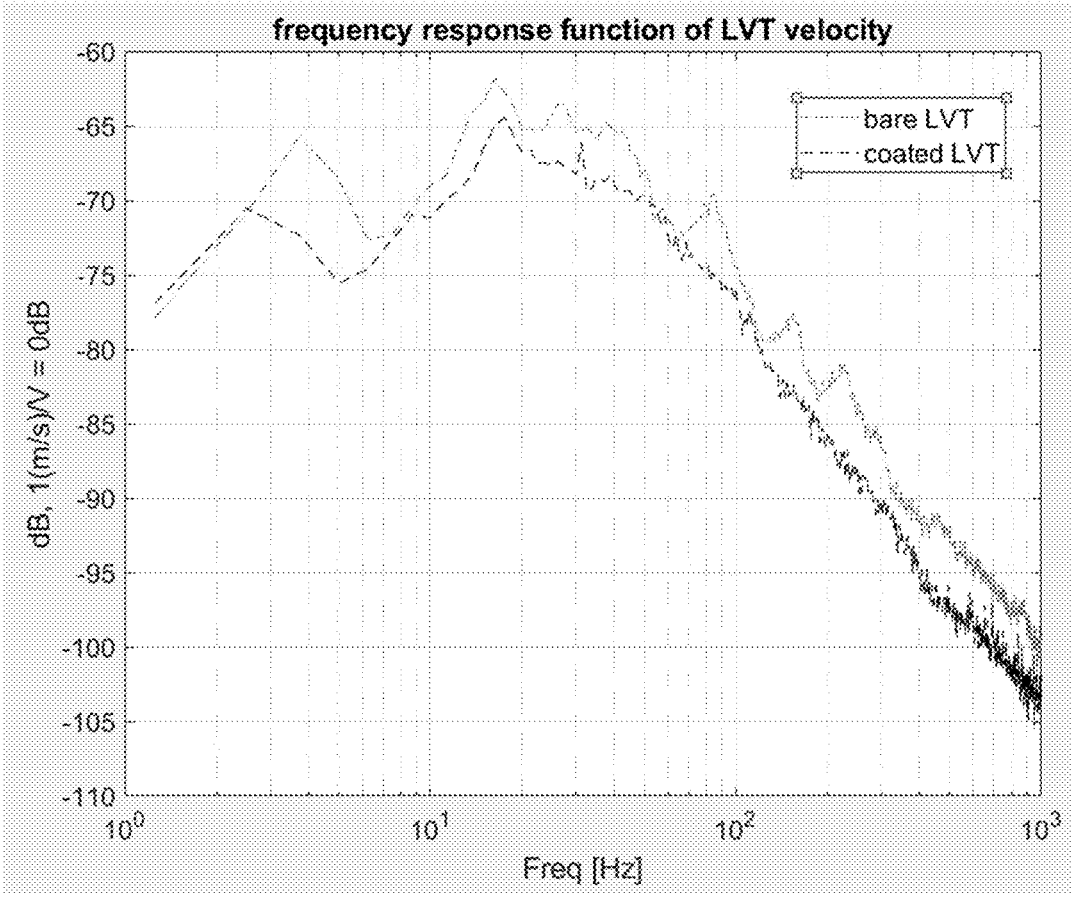
frequency response function of LVT velocity
bare LVT
coated LVT
dB, 1(m/s)/V = 0dB
-60
-65
-70
-75
-80
-85
-90
-95
-100
-105
-110
$10^0$
$10^1$
$10^2$
$10^3$
Freq [Hz]

SOUND DAMPENED FLOORING WITH IMPROVED ACOUSTIC PERFORMANCE

FIELD OF THE INVENTION

The present invention relates to sound dampened flooring and methods for making sound dampened flooring.

DESCRIPTION OF THE RELATED ART

Flooring comes in many forms. Solid hardwood floors and ceramic tiles are often preferred for their looks and the properties associated with such floors. Due to the cost of solid hardwood and ceramic tile, less expensive alternatives have been developed, such as resilient vinyl flooring, engineered wood flooring, and laminate flooring.

Engineered wood flooring typically comprises a thin layer of solid wood on top of a layer of a wood or wood fiber composite, such as plywood or fiberboard.

Laminate flooring comprises a print or decorating layer, often covered with a clear or wear layer, that is laminated to a layer of a wood composite, such as plywood or fiberboard.

Resilient vinyl flooring comes in many forms, including solid core, foam core, and flexible flooring. Flexible flooring contains plasticizer while solid core flooring does has no plasticizer. As its name suggests, foam core flooring contains a foam layer.

Resilient vinyl flooring is typically made from various layers, which may include a base layer, a print or decorating layer, and a clear or wear layer. The base layer is usually a highly filled thermoplastic, such as polyvinyl chloride (PVC) filled with calcium carbonate, and is typically the major component of resilient vinyl flooring. The print layer provides aesthetic appearance while the clear layer provides wear resistance and allows the print layer to be seen. On top of the wear layer, an ultraviolet coating may be applied to improve wear performance.

In the past few years, luxury vinyl tile (LVT) has become a fast-growing segment boosted by innovations that enable manufacturers to produce LVTs with the appearance of hardwood or ceramic tile.

One of the major drawbacks of vinyl flooring, including LVT, is that the sound of the vinyl flooring does not match the look. Resilient vinyl flooring has a distinct sound during its usage. While the sound of vinyl may be appealing to audiophiles listening to their record collections, the sound of vinyl flooring is unappealing compared to the characteristic sounds of hardwood and ceramic tile flooring.

During use, resilient vinyl flooring will emit noise either through movement within the room (heels clicking) or to a floor below the room (footsteps, furniture dragging). In both cases, the typical acoustic properties of vinyl flooring are not desirable. Wood is known to produce a characteristic sound within a room when walked on. Even though vinyl flooring may have a wood-like appearance, the sound it makes is unlike wood and ruins the illusion. In addition, there is a need to limit the amount of vibration transmitted through the floor to the room below. Specific applications such as medical facilities, schools, and libraries require low sound transmission.

Engineered wood flooring and laminate flooring also suffer from the same acoustic problems as resilient vinyl flooring, and do not have the same acoustic properties as solid hardwood or ceramic floors. Therefore, like resilient vinyl flooring, engineered wood flooring and laminate flooring may have the upscale look of solid hardwood or ceramic floors, but acoustically fall flat.

Often resilient vinyl flooring engineered wood flooring and laminate flooring are mounted as floating floors, where the floor tiles are configured to interlock with one another without being directly fastened to the floor. In contrast, solid hardwood floors are typically nailed to the subfloor and ceramic floors are adhered to the subfloor, which leads to quieter floors in general by eliminating the echoing space between the floor and subfloor.

Currently various underlayment materials, such as foam, cork or rubber sheets, are installed for noise reduction. However, the use of an underlayment requires an additional installation step that is labor intensive and the underlayment still may not meet the sound reduction target. Further, the underlayment may simply reduce the volume of the floor without changing its acoustic signature.

Attempts have been made to use damping materials in flooring through the use of a constrained layer in the flooring's laminate structure. A constrained layer is a layer that is contained within the laminate structure, i.e., a constrained layer has at least one additional rigid layer above and below the constrained layer.

For example, U.S. Pat. No. 8,640,824 discloses a vinyl tile with a constrained acoustical portion comprising a crumb rubber component, a polyurethane foam, and a resin binder. The crumb rubber can be made from recycled tires or sneaker rubber.

U.S. Patent Application Publication No. 2014/0302294 discloses a constrained layer in an acoustical vinyl tile that comprises individual layers chosen from any variety of rubber, cork, and polyurethane foam.

U.S. Pat. No. 8,146,310 discloses a noise controlling system that comprises a system for controlling noise. The system comprises multiple layers including a net layer with multiple polymer filaments and air to create a void space.

These attempts to dampen noise require complex changes to existing production lines, as well as require multiple components to attenuate noise.

U.S. Pat. No. 9,157,241 discloses a ceramic tile having a layer of damping material bound to the tile. The damping material may comprise bitumen, styrene-acrylic based polymers, and polyvinyl butyral, and the layer of damping material must be adhered to the ceramic tile, and the completed tile must, in turn, be adhered to the subfloor with an additional adhesive layer. This ceramic tile, therefore, requires multiple steps to produce the ceramic tile and additional steps to install the tile.

There is a great need for flooring that has an improved acoustic profile that solves one or more of the problems identified above.

BRIEF SUMMARY OF THE INVENTION

The present invention provides a method for preparing sound dampened flooring comprising providing a flooring substrate, applying a coating of a liquid acrylic sound damping composition to a surface of the flooring substrate, drying the coating, and optionally, forming one or more additional layers on the coating. The liquid acrylic sound damping composition comprises an acrylic vibrational damping polymer and at least one filler.

Further, sound dampened vinyl flooring is provided by the present invention.

BRIEF DESCRIPTION OF THE DRAWINGS

FIG. 1 shows the velocity spectrum of a sound dampened vinyl floor tile with respect to shaker input voltage according to an embodiment of the present invention.

DETAILED DESCRIPTION OF THE INVENTION

The present invention provides a method of preparing a sound dampened flooring. The method comprises providing a flooring substrate, applying a coating of a liquid acrylic sound damping composition to a surface of the flooring substrate, drying the coating, and optionally, forming one or more additional layers on the coating.

As used herein, a "flooring substrate" refers to a rigid layer or laminate comprising multiple layers of a floor tile. Preferably, the flooring substrate comprises the upper portion of the finished floor tile, and the coating formed by the liquid acrylic sound damping composition and any optional additional layers formed on the coating may form the lower portion of the finished floor tile. More preferably, the flooring substrate resembles a finished floor tile but for the acrylic sound damping coating. Resilient vinyl flooring typically contains a base layer, a print or decorating layer, and a clear or wear layer. For resilient vinyl flooring, the flooring substrate may comprise the base layer and any additional layers. For example, the flooring substrate may comprise a laminate of the base layer, the print or decorating layer, and clear or wear layer. Alternatively, the flooring substrate for resilient vinyl flooring may comprise the base layer, and the other layers are formed subsequent to coating the liquid acrylic sound damping composition.

As used herein, a "floor tile" refers to a single piece of flooring that is part of a system comprising a plurality of pieces and is intended to encompass both tiles and planks. The floor tile may be square, rectangular, or other geometric shape. Preferably, the floor tile is configured to have an interlocking feature that allows each floor tile to interconnect with adjacent floor tiles. Even more preferably, the floor tile is configured to be a floating floor where the floor tiles interlock and are not adhered or mechanically fastened to a subfloor.

The sound dampened flooring of the present invention may be a resilient vinyl flooring, an engineered wood flooring, or a laminate flooring.

The liquid acrylic sound damping composition provides excellent sound damping performance when used as sound damping layer in flooring, as described below.

The liquid acrylic sound damping composition comprises an acrylic vibrational damping polymer and at least one filler. The liquid acrylic sound damping composition may further comprise a carrier. As used herein, an "acrylic vibrational damping polymer" refers to an acrylic polymer or copolymer that is capable of attenuating vibrations, or sound, in flooring. The acrylic vibrational damping polymer may attenuate single frequencies of vibration, all frequencies or vibrations, or one or more bands of vibration frequencies. For example, the acrylic vibrational damping polymer may attenuate vibration frequencies created by footsteps when a person walks across the floor.

The acrylic vibrational damping polymer preferably comprises a linear acrylic polymer or copolymer. Alternatively, at least a portion of the acrylic vibrational damping polymer may also comprise a crosslinked or branched component.

The acrylic vibrational damping polymer may be prepared from one or more alkyl (meth)acrylate monomers. Alkyl (meth)acrylate monomers that may be used in the preparation of the acrylic vibrational damping polymer include, but are not limited to ethyl (meth)acrylate, ethyl hexyl (meth) acrylate, methyl (meth)acrylate, glycidyl methacrylate, butyl (meth)acrylate, lauryl (meth)acrylate, poly(ethylene glycol) methacrylate, and 1,3-butylene glycol dimethacrylate. As used herein, "alkyl (meth)acrylate" refers to both the alkyl acrylate and the alkyl methacrylate.

In addition to the at least one alkyl (meth)acrylate monomer, additional monomers may also be used to prepare the acrylic vibrational damping polymer. For example, the acrylic vibrational damping polymer may be prepared from at least one alkyl (meth)acrylate monomer and an additional monomer. The additional monomer may be selected from, for example, styrene monomers and acrylamide monomers, such as, for example, dimethyl acrylamide and diacetone acrylamide.

The additional monomer may also comprise a phosphorus acid monomer that contains at least one ethylenic unsaturation and a phosphorus acid group to form a phosphate functionalized acrylic vibrational damping polymer. The phosphorus acid monomer may be in the acid form or as a salt of the phosphorus acid groups. Examples of phosphorus acid monomers include:

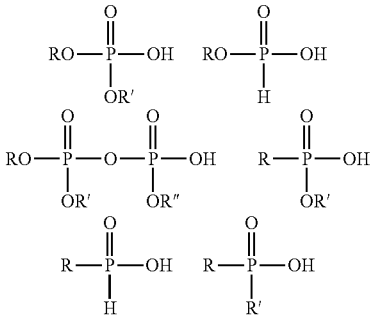

wherein R is an organic group containing an acryloxy, methacryloxy, or a vinyl group, and R' and R" are independently selected from H and a second organic group. The second organic group may be saturated or unsaturated. Suitable phosphorus acid monomers include dihydrogen phosphate-functional monomers such as dihydrogen phosphate esters of an alcohol in which the alcohol also contains a polymerizable vinyl or olefinic group, such as allyl phosphate, mono- or diphosphate of bis(hydroxy-methyl)fumarate or itaconate, derivatives of (meth)acrylic acid esters, such as, for examples phosphates of hydroxyalkyl(meth) acrylates including 2-hydroxyethyl (meth)acrylate, 3-hydroxypropyl(meth)acrylates, and the like. Other suitable phosphorus acid monomers are phosphonate-functional monomers, disclosed in WO 99/25780 A1, and include vinyl phosphonic acid, allyl phosphonic acid, 2-acrylamido-2-methylpropanephosphonic acid, α-phosphonostyrene, 2-methylacrylamido-2-methylpropanephosphonic acid. Further suitable phosphorus functional monomers are 1,2-ethylenically unsaturated (hydroxy)phosphinylalkyl(meth) acrylate monomers, disclosed in U.S. Pat. No. 4,733,005, and include (hydroxy)phosphinylmethyl methacrylate. Preferred phosphorus acid monomers are dihydrogen phosphate monomers, which include 2-phosphoethyl(meth)acrylate, 2-phosphopropyl(meth)acrylate, 3-phosphopropyl(meth) acrylate, and 3-phospho-2-hydroxypropyl(meth)acrylate. When present, phosphorus acid monomer may be present in an amount ranging from 0.03 to 3 wt % relative to the total weigh of the monomers forming the acrylic vibrational damping polymer.

The acrylic vibrational damping polymer may comprise a core-shell acrylic polymer. For example, the core-shell acrylic polymer may comprises a butyl acrylate core and a methyl methacrylate shell. Preferably, the core comprises a linear acrylic polymer. The shell may comprise a crosslinked polymer, such as, for example, a crosslinked methyl methacrylate.

The acrylic vibrational damping polymer may have a glass transition temperature, $T_g$, ranging from −20° C. to 30° C. Preferably, the acrylic vibrational damping polymer has a $T_g$ ranging from −10° C. to 20° C., and more preferably, from 0° C. to 10° C. The $T_g$ is calculated with the Fox equation [Bulletin of the American Physical Society 1, 3 Page 123 (1956)]. The Fox equation calculates the T g as follows:

$$\frac{1}{T_g} = \frac{w_1}{T_{g(1)}} + \frac{w_2}{T_{g(2)}}$$

In the Fox equation, $w_1$ and $w_2$ refer to the weight fraction of the two comonomers, based on weight of monomers charged to the reaction vessel, and $T_{g(1)}$ and $T_{g(2)}$ refer to the glass transition temperatures of the two corresponding homopolymers in degrees Kelvin. When three or more monomers are present, additional terms are added ($w_n/T_{g(n)}$). The glass transition temperatures of homopolymers for the purposes of this invention are those reported in "Polymer Handbook", edited by J. Brandrup and E. H. Immergut, Interscience Publishers, 1966, unless that publication does not report the Tg of a particular homopolymer, in which case the Tg of the homopolymer is measured by differential scanning calorimetry (DSC). To measure the glass transition temperature of a homopolymer by DSC, the homopolymer sample is prepared and maintained in the absence of ammonia or primary amine. The homopolymer sample is dried, preheated to 120° C., rapidly cooled to −100° C., and then heated to 150° C., at a rate of 20° C./minute while data is collected. The glass transition temperature for the homopolymer is measured at the midpoint of the inflection using the half-height method.

The acrylic vibrational damping polymer may be present in the liquid acrylic sound damping composition in an amount ranging from 5 to 50 wt. % based on the total weight of the liquid acrylic sound damping composition. Preferably, the acrylic vibrational damping polymer is present in an amount ranging from 10 to 40 wt. % based on the total weight of the liquid acrylic sound damping composition, and more preferably, in an amount ranging from 15 to 35 wt. %.

The at least one filler is present in an amount ranging from 15 to 75 wt. % based on the total weight of the liquid acrylic sound damping composition. Preferably, the at least one filler is present in an amount ranging from 25 to 70 wt. % based on the total weight of the liquid acrylic sound damping composition, such as, for example, from 35 to 65 wt. %.

The at least one filler may comprise a mineral filler. Examples of mineral fillers include, but are not limited to calcium carbonate, talc, silica, wollastonite, clay (e.g., kaolin), and mica. The at least one filler may also comprise other fillers, such as, for example, glass fibers, glass beads, carbon fiber, and graphite.

The at least one filler may comprise a platy filler, which is a filler having a plate-like or platelet shape. When the at least one filler comprises a platy filler, the platy filler may be present in an amount ranging from 0.5 to 15 wt. % based on the total weight of the liquid acrylic sound damping composition. Examples of platy fillers include, but are not limited to, mica, graphite, talc, and kaolin. Preferably, when the liquid acrylic sound damping composition comprises a platy filler, the platy filler is mica or graphite, and more preferably, mica.

The at least one filler may comprise a combination of two or more fillers. For example, the liquid acrylic sound damping composition may comprise calcium carbonate and mica.

The liquid acrylic sound damping composition comprises a carrier. The carrier is present to adjust the amount of solids in the liquid acrylic sound damping composition. The carrier may comprise water or an organic material. Preferably, the carrier is water.

The carrier may be present in an amount ranging from 10 to 50 wt. % based on the total weight of the liquid acrylic sound damping composition, such as, for example, from 20 to 40 wt. %.

The liquid acrylic sound damping composition may further comprise additional components. For example, the liquid acrylic sound damping composition may comprise an additive selected from defoamers, dispersants, pigments, coalescent agents, film forming agents, and thickeners.

The coating of the liquid acrylic sound damping composition may be applied at a loading ranging from 0.5 to 8 kg/m$^2$. Generally, the higher the loading, the higher the resulting sound dampening of the dried sound damping composition. Preferably, the coating of the liquid acrylic sound damping composition is applied at a loading ranging from 2 to 6 kg/m$^2$, and more preferably, at a loading ranging from 3 to 5 kg/m$^2$.

The liquid acrylic sound damping composition may be coated on the flooring substrate using any known method. For example, the liquid acrylic sound damping composition may be applied using a curtain coater, a spray coater, or an extruder.

The flooring substrate with the applied coating of the liquid acrylic sound damping composition is then dried. The applied liquid acrylic sound damping composition can be dried by heating the coated flooring substrate or by drying the coating in air, either forced air or unforced air. The type and amount of the carrier may be selected to aid drying the applied coating.

Preferably, the liquid acrylic sound damping composition is applied to a bottom surface of the flooring substrate, i.e., the surface between the flooring and the subfloor. When applied to the bottom of the flooring substrate, the process for producing flooring may be minimally altered. For example, an existing production line can be modified by adding an additional step to the end of the process by coating an otherwise finished floor tile with the liquid acrylic sound damping composition.

Alternatively, the liquid acrylic sound damping composition can be applied to another surface within the flooring substrate, e.g., as an interior or constrained layer within the floor tile. This process may require additional modification of existing production processes, but would allow for more flexibility with regard to where the sound damping layer is applied. When the sound damping layer is a constrained layer, a second rigid layer preferably sandwiches the sound damping layer between flooring substrate.

The floor tile produced by the method of the present invention may not require an additional underlayment because the sound damping layer may function as the underlayment. In conventional floating floors, an underlayment, such as foam, cork, rubber, or felt, is first installed on the subfloor, and then the flooring is installed on top of the underlayment. The underlayment is used to provide sound dampening, soften the feel of the floor underfoot, and/or act as a moisture barrier. The sound damping layer of the present invention may provide one or more of the same functions as a traditional underlayment.

The invention has been described in an illustrative manner, and it is to be understood that the terminology which has been used is intended to be in the nature of words of description rather than of limitation. Obviously, many modifications and variations of the present invention are possible in light of the above teachings. The invention may be practiced otherwise than as specifically described.

EXAMPLES

Liquid acrylic sound damping compositions were provided by slowly adding, in the order shown, the components shown in Table 1 using an IKA RW28 bench mixer. As the thickener was added, the mixing speed was increased to maintain complete incorporation as the viscosity increased. After the formulation was complete, the liquid acrylic sound damping compositions were further mixed for several minutes to ensure homogeneity.

TABLE 1

| Material | Function | Mass |
|---|---|---|
| 100% acrylic copolymer latex in water (approx. 50% solids content) | vibrational damping polymer | 30.04 |
| Water (to adjust solids) | solids adjustment | 4.88 |
| DOWSIL ™ 8590 (Dow Chemical Co.) | defoamer | 0.16 |
| TAMOL ™ 1254 (Dow Chemical Co.) | dispersant | 0.53 |
| UCD ® 1530E Black (Chromaflow Technologies) | carbon black dispersion | 0.47 |
| TITAN ® 200 (Omya) | coarse calcium carbonate | 56.07 |
| Mica-325 | platy filler, mica | 5.85 |
| Propylene Glycol | ambient film formation | 0.82 |
| DOWANOL ™ DPnB (Dow Chemical Co.) | coalescent | 0.82 |
| ACRYSOL ™ TT-615 (Dow Chemical Co.) | HASE co-thickener | 0.27 |
| ACRYSOL ™ RM-12W (Dow Chemical Co.) | HEUR co-thickener | 0.09 |
| Total | | 100.00 |

A coating of the liquid acrylic sound damping composition was drawn down over the underside of a 12×12 in. (30.5×30.5 cm) vinyl floor tile in a 3.2 mm mold and allowed to air dry for 72 hours. The liquid acrylic sound damping composition was applied to a 10×10 in. (25.4×25.4 cm) area at a loading of 0.922 lb/ft$^2$ (4.5 kg/m$^2$). The coated vinyl floor tile was freely suspended in air using 2 rubber bands attached to two adjacent corners of the vinyl floor tile to hold the vinyl floor tile perpendicular to the floor. A shaker was attached to the suspended vinyl floor tile along an edge opposite the side suspended with the rubber bands. The shaker attachment point was located closer to one side than the other.

The vinyl floor tile was excited using a broadband vibration signal from the shaker and a laser vibrometer positioned at a distance from the suspended vinyl floor tile was used to measure the velocity of the vinyl floor tile. The vibrometer scanned several points along the surface of the vinyl floor tile and Polytech data acquisition and analysis software was used for obtaining average vinyl floor tile velocity and frequency spectrum. An identical, but uncoated, vinyl floor tile was also tested for comparison.

The velocity spectrum of the vinyl floor tiles, normalized with respect to shaker input voltage, is provided for both vinyl floor tiles in the FIGURE. The uncoated vinyl floor tile exhibited peaks in velocity responses that correspond to natural vibration modes. The vinyl floor tile coated with the liquid acrylic sound damping composition according to the present invention suppressed the natural modes effectively and showed substantial improvements in vibration behavior in the entire frequency range as shown in the FIGURE.

Definitions and Usage of Terms

Unless otherwise indicated by the context of the specification, all amounts, ratios and percentages are by weight, and all test methods are current as of the filing date of this disclosure. The articles "a", "an" and "the" each refer to one or more. It is to be understood that the appended claims are not limited to express and particular compounds, compositions, or methods described in the detailed description, which may vary between particular embodiments which fall within the scope of the appended claims. With respect to any Markush groups relied upon herein for describing particular features or aspects of various embodiments, different, special, and/or unexpected results may be obtained from each member of the respective Markush group independent from all other Markush members. Each member of a Markush group may be relied upon individually and or in combination and provides adequate support for specific embodiments within the scope of the appended claims.

Further, any ranges and subranges relied upon in describing various embodiments of the present invention independently and collectively fall within the scope of the appended claims, and are understood to describe and contemplate all ranges including whole and/or fractional values therein, even if such values are not expressly written herein. One of skill in the art readily recognizes that the enumerated ranges and subranges sufficiently describe and enable various embodiments of the present invention, and such ranges and subranges may be further delineated into relevant halves, thirds, quarters, fifths, and so on. As just one example, a range "of from 0.1 to 0.9" may be further delineated into a lower third, i.e., from 0.1 to 0.3, a middle third, i.e., from 0.4 to 0.6, and an upper third, i.e., from 0.7 to 0.9, which individually and collectively are within the scope of the appended claims, and may be relied upon individually and/or collectively and provide adequate support for specific embodiments within the scope of the appended claims. In addition, with respect to the language which defines or modifies a range, such as "at least," "greater than," "less than," "no more than," and the like, it is to be understood that such language includes subranges and/or an upper or lower limit. As another example, a range of "at least 10" inherently includes a subrange of from at least 10 to 35, a subrange of from at least 10 to 25, a subrange of from 25 to 35, and so on, and each subrange may be relied upon individually and/or collectively and provides adequate support for specific embodiments within the scope of the appended claims. Finally, an individual number within a disclosed range may be relied upon and provides adequate support for specific embodiments within the scope of the appended claims. For example, a range "of from 1 to 9" includes various individual integers, such as 3, as well as individual numbers including a decimal point (or fraction), such as 4.1, which may be relied upon and provide adequate support for specific embodiments within the scope of the appended claims.

The term "composition," as used herein, includes material(s) which comprise the composition, as well as reaction products and decomposition products formed from the materials of the composition.

The term "comprising," and derivatives thereof, is not intended to exclude the presence of any additional component, step or procedure, whether or not the same is disclosed herein. In order to avoid any doubt, all compositions claimed herein through use of the term "comprising" may include any additional additive, adjuvant, or compound, whether polymeric or otherwise, unless stated to the contrary. In contrast, the term, "consisting essentially of" excludes from the scope of any succeeding recitation any other component, step or procedure, excepting those that are not essential to operability. The term "consisting of" excludes any component, step or procedure not specifically delineated or listed.

The term "polymer," as used herein, refers to a polymeric compound prepared by polymerizing monomers, whether of the same or a different type. The generic term polymer thus embraces the term homopolymer (employed to refer to polymers prepared from only one type of monomer, with the understanding that trace amounts of impurities can be incorporated into the polymer structure), and the term copolymer (employed to refer to polymers prepared from two or more types of monomers).

What is claimed is:

1. A method of preparing sound dampened flooring comprising tiles and/or planks, said method comprising the steps of:

providing a flooring substrate comprising vinyl or laminate flooring;

applying a coating of a liquid acrylic sound damping composition to a bottom surface of the flooring substrate, wherein the liquid acrylic sound damping composition comprises an acrylic vibrational damping polymer and at least one filler; and drying the coating;

wherein the flooring substrate comprises a print or decorating layer, and optionally a clear or wear layer.

2. The method of claim 1, wherein the coating of the liquid acrylic sound damping composition is applied at a loading of 0.5 to 8 $kg/m^2$.

3. The method of claim 2, wherein the coating of the liquid acrylic sound damping composition is applied at a loading of 2 to 6 $kg/m^2$.

4. The method of claim 1, wherein the coating of the liquid acrylic sound damping composition is applied by a curtain coater, a spray coater, or an extruder.

5. The method of claim 1, wherein the sound dampened flooring is configured for floating floor installation.

6. The method of claim 1, wherein the at least one filler comprises at least one platy filler in an amount ranging from 0.5 to 15 vol % based on the total volume of the liquid acrylic sound damping composition.

7. The method of claim 6, wherein the at least one platy filler is selected from the group consisting of mica, graphite, talc, and kaolin.

8. The method of claim 1 wherein the acrylic vibrational damping polymer comprises a linear acrylic polymer or copolymer.

9. The method of claim 1, wherein the acrylic vibrational damping polymer comprises a phosphate functionalized linear acrylic copolymer.

10. The method of claim 1, wherein the acrylic vibrational damping polymer comprises a core shell polymer comprising a linear acrylic copolymer core.

11. A sound dampened flooring produced by the method of claim 1.

12. The sound dampened flooring of claim 11, wherein the coating is an outermost layer on the sound dampened flooring.

13. The sound dampened flooring of claim 11, wherein the coating is a constrained layer between the substrate and an additional layer.

14. The sound dampened flooring of claim 11 further comprising a clear or wear layer.

15. The method of claim 1 further comprising the step of forming one or more additional layers of the acrylic vibrational damping polymer.

16. The method of claim 1, wherein the acrylic vibrational damping polymer has a glass transition temperature ($T_g$) of from −20 to 30° C.

17. The method of claim 1, wherein the liquid acrylic sound damping composition further comprises an ambient film forming agent.

18. The method of claim 1, wherein the liquid acrylic sound damping composition further comprises thickener selected from an alkali swellable acrylic polymer and a hydrophobically modified ethylene oxide urethane.

* * * * *